US011739903B2

(12) United States Patent
Abe

(10) Patent No.: US 11,739,903 B2
(45) Date of Patent: Aug. 29, 2023

(54) MOVABLE SHADE MECHANISM FOR VEHICLE HEADLIGHT, AND VEHICLE HEADLIGHT

(71) Applicant: Ichikoh Industries, Ltd., Isehara (JP)

(72) Inventor: Toshiya Abe, Isehara (JP)

(73) Assignee: Ichikoh Industries, Ltd., Isehara (JP)

( * ) Notice: Subject to any disclaimer, the term of this patent is extended or adjusted under 35 U.S.C. 154(b) by 0 days.

(21) Appl. No.: 17/773,549

(22) PCT Filed: Oct. 23, 2020

(86) PCT No.: PCT/JP2020/039902
§ 371 (c)(1),
(2) Date: Apr. 29, 2022

(87) PCT Pub. No.: WO2021/085328
PCT Pub. Date: May 6, 2021

(65) Prior Publication Data

US 2022/0381413 A1 Dec. 1, 2022

(30) Foreign Application Priority Data

Oct. 30, 2019 (JP) ..... 2019-197485

(51) Int. Cl.
*F21S 41/43* (2018.01)
*F21S 41/683* (2018.01)
*F21S 41/47* (2018.01)

(52) U.S. Cl.
CPC ..... *F21S 41/683* (2018.01); *F21S 41/43* (2018.01); *F21S 41/47* (2018.01)

(58) Field of Classification Search
CPC ..... F21S 41/683; F21S 41/47; F21S 41/43
See application file for complete search history.

(56) References Cited

U.S. PATENT DOCUMENTS

2011/0141753 A1* 6/2011 Tanaka ..... F21S 41/689 362/464
2015/0022084 A1* 1/2015 Suzuki ..... B60Q 1/1415 315/82

FOREIGN PATENT DOCUMENTS

JP 2014-146463 A 8/2014

OTHER PUBLICATIONS

International Search Report dated Dec. 8, 2020 in PCT/JP2020/039902 filed on Oct. 23, 2020 (citing reference AO, therein, 2 pages).

* cited by examiner

*Primary Examiner* — Anne M Hines
(74) *Attorney, Agent, or Firm* — Oblon, McClelland, Maier & Neustadt, L.L.P.

(57) ABSTRACT

A movable shade mechanism for a vehicular headlight and a vehicular headlight capable of reducing the entire weight while enhancing rigidity of a bracket is provided. A movable shade mechanism for a vehicular headlight includes a shade member rotating around a rotary shaft and adjusting a shielding amount of light from a light source, a drive unit to generate power to drive the shade member, a transmission member to transmit power of the drive unit to the shade member, and a plate bracket to hold the rotary shaft and the drive unit, wherein the bracket includes a base that is disposed along a horizontal plane in a vehicle-mounted state and supports the drive unit, and a shade support that is bent upwardly from a rear end of the base in the vehicle-mounted state and supports the rotary shaft.

7 Claims, 5 Drawing Sheets

MOVABLE SHADE MECHANISM FOR VEHICLE HEADLIGHT, AND VEHICLE HEADLIGHT

TECHNICAL FIELD

The present invention relates to a movable shade mechanism for a vehicular headlight and a vehicular headlight.

BACKGROUND ART

It is conventionally known in the field of technology involving a vehicular headlight that the vehicular headlight is provided with a movable shade mechanism to control light distribution of light from a light source. For example, Patent Literature 1 discloses a vehicular headlight provided with movable shade, solenoid to rotate the movable shade, and link member to transmit power of the solenoid to the movable shade.

CITATION LIST

Patent Literature

Patent Literature 1: Japanese Patent Laid-open Publication No. 2014-146463

SUMMARY OF THE INVENTION

Problems to be Solved by the Invention

In the movable shade mechanism for such a vehicular headlight as disclosed in the Patent Literature 1, a solenoid is fixed on a piece part made by bending a flat bracket. However, the solenoid is a heavy component with copper wires and steel plates. Therefore, when it is attached to the above mentioned piece made by bending the bracket, the bracket becomes likely to be deformed by vibration and impact, etc. Therefore, it is necessary to increase the thickness of the bracket to enhance rigidity, so that this makes it difficult to reduce the weight of the movable shade mechanism.

In light of the foregoing, the present invention has been made, and whose object is to provide a movable shade mechanism for a vehicular headlight and a vehicular headlight capable of reducing the entire weight of the mechanism while enhancing rigidity of a bracket.

Means for Solving the Problem

A movable shade mechanism for a vehicular headlight according to the present invention includes: a shade member rotating around a rotary shaft and adjusting a shielding amount of light from a light source; a drive unit to generate power to drive the shade member; a transmission member to transmit power of the drive unit to the shade member; and a plate bracket to hold the rotary shaft and the drive unit, wherein the bracket includes: a base that is disposed along a horizontal plane in a vehicle-mounted state and supports the drive unit; and a shade support that is bent upwardly from a rear end of the base in the vehicle-mounted state and supports the rotary shaft.

In the above mentioned movable shade mechanism for a vehicular headlight, the bracket may include a reinforcement part that is bent downwardly from a front end of the base.

In the above mentioned movable shade mechanism for a vehicular headlight, the base may have an attachment part extending outwardly in a left-right direction in the vehicle-mounted state.

In the above mentioned movable shade mechanism for a vehicular headlight, the base may have opening that penetrates through the base in an up-down direction in the vehicle-mounted state, and the transmission member may pass through the opening in the up-down direction to be disposed.

The above mentioned movable shade mechanism for a vehicular headlight may further include a cover member that is mounted on the base and covers the opening.

In the above mentioned movable shade mechanism for a vehicular headlight, the drive unit may have a case, the case may have a shape that a plate member is bent in a front-rear direction and a left-right direction in the vehicle-mounted state, and has a plurality of protrusions to be mated with the base on a top of the case in an up-down direction, at least one or more of the plurality of protrusions may be provided at a position where the front-rear direction is a plate thickness direction as well as a position where the left-right direction is the plate thickness direction, on the top of the base, and the base may have mating holes which the plurality of protrusions are inserted into.

A vehicular headlight according to the present invention includes: a light source; and the above-described movable shade mechanism for a vehicular headlight, which controls light distribution of light from the light source.

Effect of the Invention

According to the present invention, it is possible to provide a movable shade mechanism for a vehicular headlight and a vehicular headlight capable of reducing the entire weight while enhancing rigidity of a bracket.

MODE FOR CARRYING OUT THE INVENTION

Now, a movable shade mechanism for a vehicular headlight and a vehicular headlight according to an embodiment of the present invention will be described bellow with reference to the drawings. It should be noted that the present invention is not limited by this embodiment. In addition, constituent elements in the following embodiment include such an element that can be easily substituted by those skilled in the art or is substantially the same. In the following explanation, each of directions, front, rear, up, down, left, and right, is defined as a direction in a vehicle-mounted state where the vehicular headlight is attached to the vehicle, which is the same direction as viewed from a driver's seat to a traveling direction of the vehicle. In this embodiment, it is also defined that the up-down direction is parallel to a vertical direction, and the left-right direction is a horizontal direction.

Figure 1:
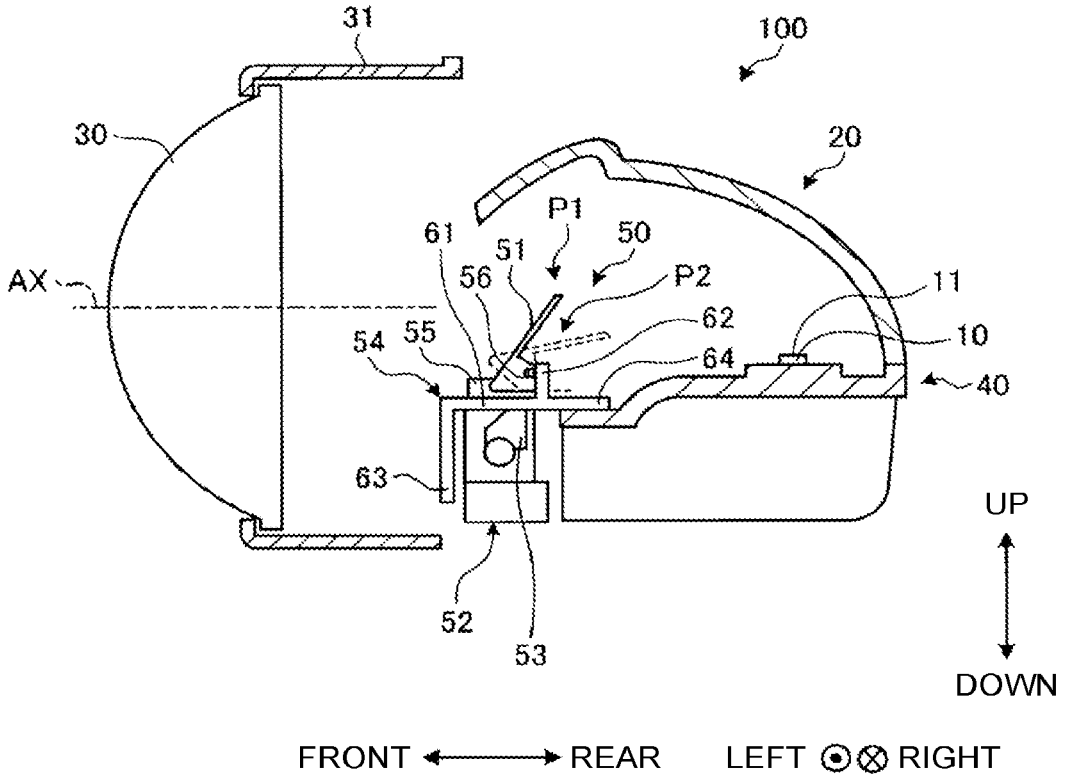
FIG. 1 is a cross-sectional view illustrating a vehicular headlight provided with a movable shade mechanism according to the present embodiment.

FIG. 1 is a cross-sectional view illustrating a vehicular headlight 100 provided with a movable shade mechanism according to the present embodiment. As shown in FIG. 1, the vehicular headlight 100 includes light source 10, reflector 20 and a lens 30, attachment member 40, and movable shade mechanism 50. The light source 10, the reflector 20, the lens 30, the attachment member 40, and the movable shade mechanism 50 constitute a so-called projector-type lamp unit.

The vehicular headlights 100 are mounted on the left and right sides of a front face of the vehicle, respectively. When mounted on a vehicle, the vehicular headlight 100 is housed in a light chamber formed with a lamp housing (not shown) and a lamp lens (such as an outer lens to go through) and connected to an optical axis adjustment mechanism (not shown). The optical axis adjustment mechanism is capable of performing optical axis adjustment in the up-down and left-right directions. An example of the vehicular headlight 100, which is mounted on the right side of a vehicle, is described bellow. In this case, with respect to the vehicular headlight 100, the right side of the vehicle in the left-right direction indicates the outside of the vehicle, and the left side of the vehicle in the left-right direction indicates the inside of the vehicle. The vehicular headlight mounted on the left side of the vehicle is configured to have a left-right symmetry with the vehicular headlight 100, so that a similar explanation can be applied.

In addition to the above mentioned lamp unit, there may be arranged in the light chamber clearance lamp unit, turn signal lamp unit, daytime running lamp unit, etc., for example. Furthermore, there may be arranged in the light chamber inner panel (not shown), inner housing (not shown), inner lens (not shown), etc.

Light Source

In this embodiment, the light source 10 is a semiconductor-type light source such as an LED or an OLED (Organic Light Emitting Diode), for example. The light source 10 has a light emitting surface 11. When the vehicular headlight 100 is mounted on a vehicle, the light emitting surface 11 is directed upwardly in parallel with a horizontal plane, for example. The light source 10 is fixed to an attachment member 40. The light source 10 is disposed below an optical axis AX of the lens 30 as described later.

Reflector

Reflector 20 reflects light from the light source 10 toward the lens 30. The reflector 20 is disposed above the light source 10 and is made of a heat-resistant and light non-transmissible material, such as a resin material. The reflector 20 is fixed to the attachment member 40 by means of a fixing member such as a screw or the like.

Lens

Lens 30 is positioned on the front side of the vehicle relative to the reflector 20. The lens 30 is supported by a lens holder 31, for example. Lens 30 has a focal point (not shown) and the optical axis AX. The optical axis AX of the lens 30 aligns with or substantially aligns with an optical axis of the reflector 20. The lens 30 emits reflection light from reflector 20 and direct light from the light source 10 forward of the vehicle.

Attachment Member

To the attachment member 40, light source 10, reflector 20, lens 30, and movable shade mechanism 50 described later are attached. The attachment member 40 also radiates heat caused by the light source 10.

Movable Shade Mechanism

The movable shade mechanism 50 is located between the light source 10 and the lens 30. As shown in FIG. 1, the movable shade mechanism 50 is provided with shade member 51, solenoid (drive unit) 52, transmission member 53, bracket 54, and cover member 55. As shown in FIG. 1, the movable shade mechanism 50 is a mechanism which adjusts a shielding amount of light emitted from the light source 10 and reflected with the reflector 20 by rotating the shade member 51 within a range between a first position P1 (see a solid line) and a second position P2 (see a broken line).

Figure 2:
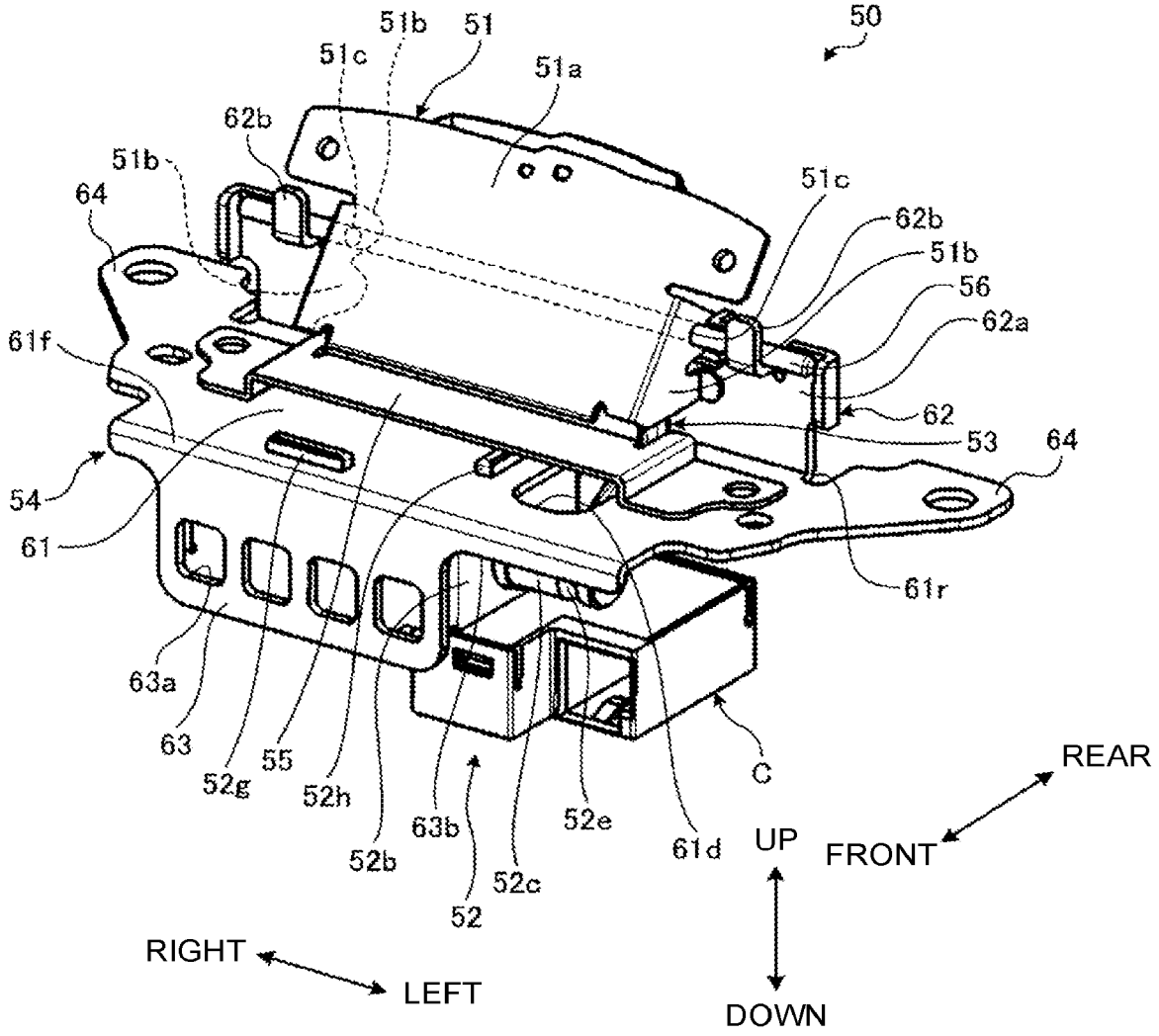
FIG. 2 is a perspective view illustrating an example of the movable shade mechanism.
Figure 3:
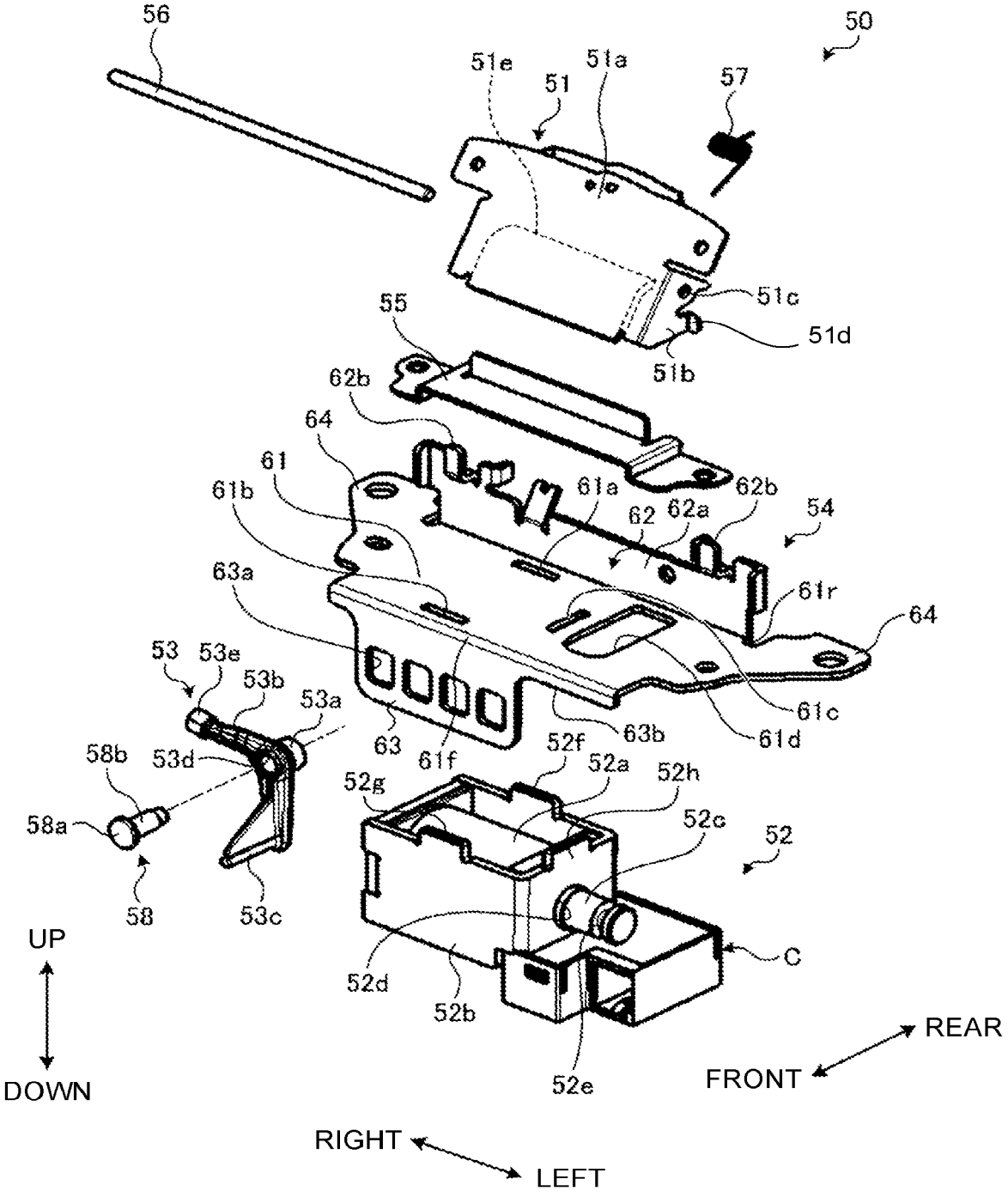
FIG. 3 is an exploded perspective view illustrating an example of the movable shade mechanism.
Figure 4:
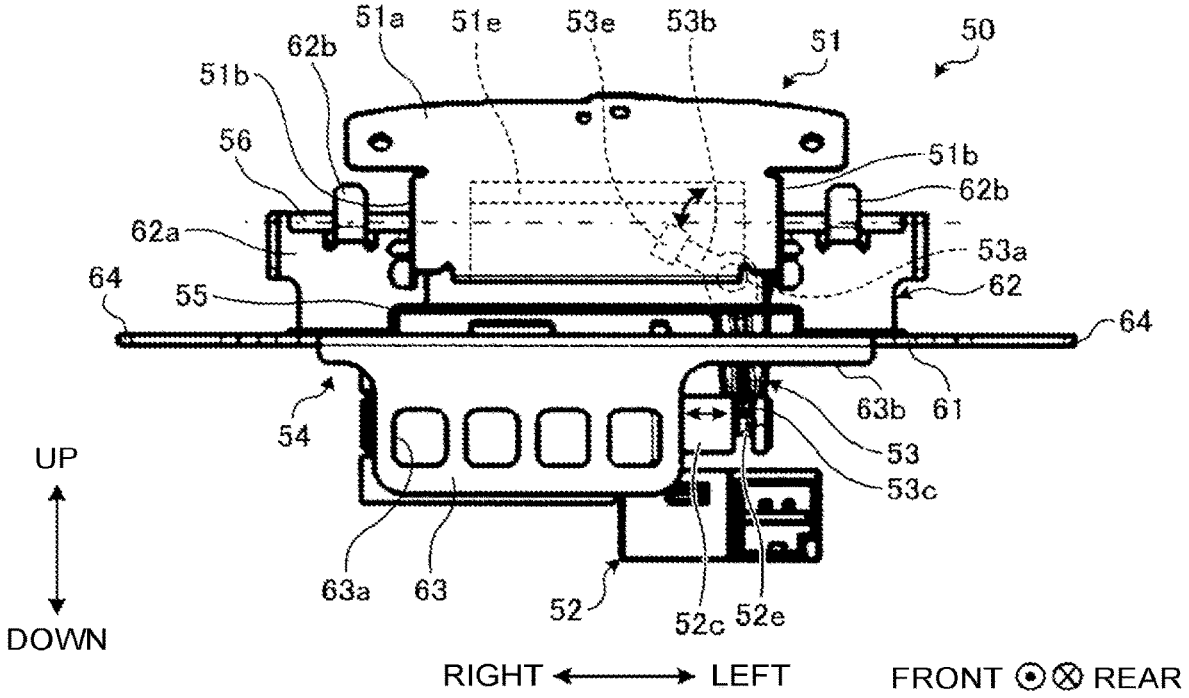
FIG. 4 is a front view illustrating an example of the movable shade mechanism when viewed from the front side.
Figure 5:
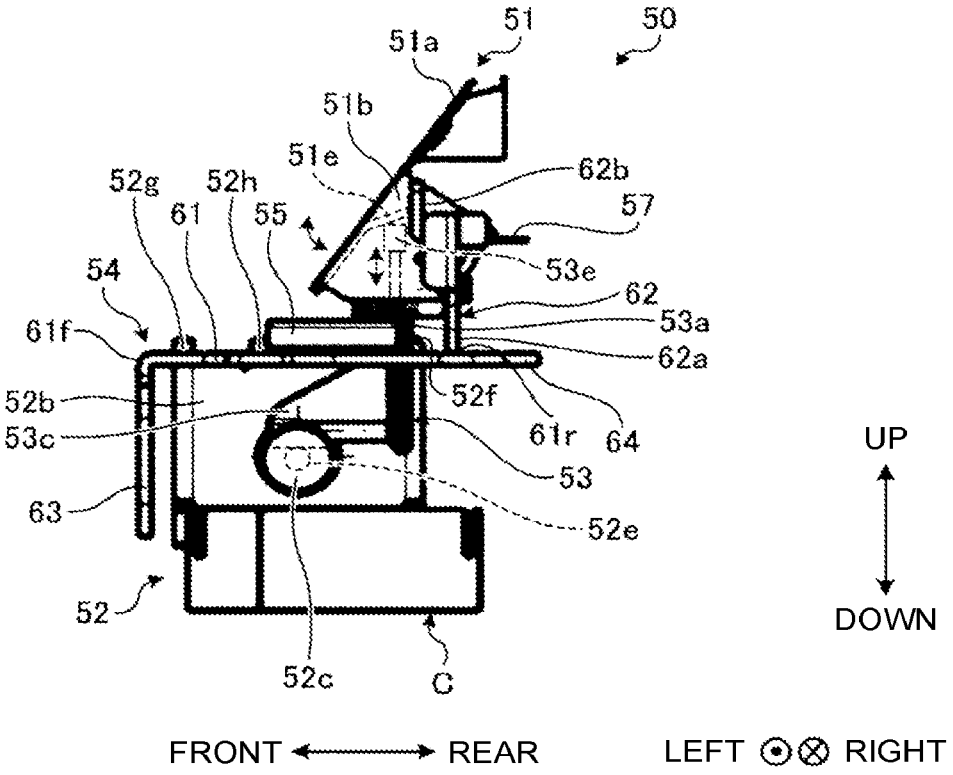
FIG. 5 is a side view illustrating an example of the movable shade mechanism when viewed from the left side.
Figure 6:
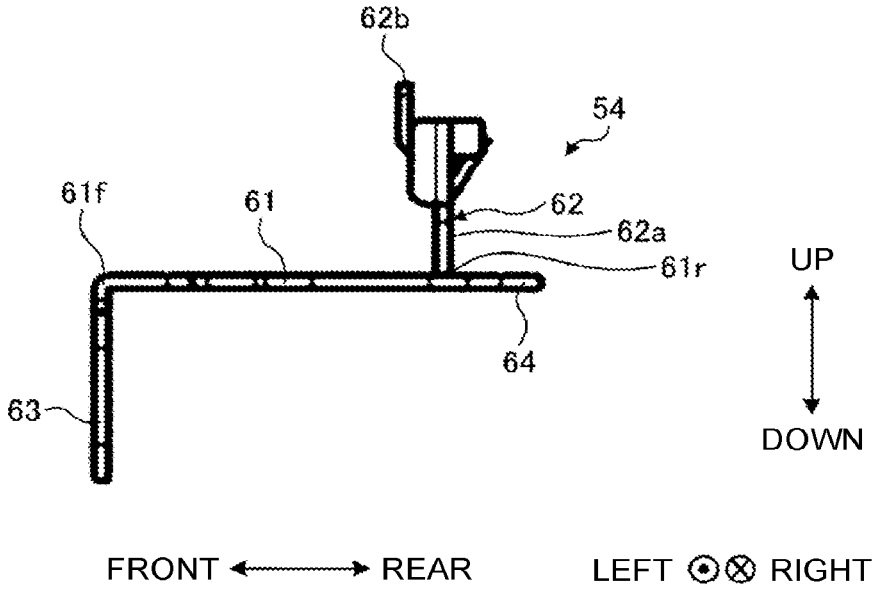
FIG. 6 is a side view illustrating an example of a bracket of the movable shade mechanism.

With reference to FIGS. 2 through 6, a configuration of the movable shade mechanism 50 is described in detail. FIG. 2 is a perspective view illustrating an example of the movable shade mechanism 50. FIG. 3 is an exploded perspective view illustrating the example of the movable shade mechanism 50. FIG. 4 is a front view illustrating the example of the movable shade mechanism 50 viewed from the front side. FIG. 5 is a side view illustrating the example of the movable shade mechanism 50 viewed from the left side. FIG. 6 is a side view illustrating an example of the bracket 54 of the movable shade mechanism 50. In FIGS. 2 through 6, the fixing member such as a screw to secure each part is omitted in order to depict.

Shade Member

The shade member 51 has a shade body 51*a* and two attachment pieces 51*b*. The shade body 51*a* is a plate member to shield a portion of light from the light source 10. One of the attachment pieces 51*b* is each formed for each of sides of the shade body 51*a*. As shown in FIG. 2, the attachment pieces 51*b* have through holes 51*c* which are coaxially aligned, respectively. A rotary shaft 56 is rotatably inserted into the through holes 51*c*. The rotary shaft 56 passes through the inside of a spring 57 (see FIG. 3, etc.) which is a torsion coil spring. One end and the other end of the spring 57 are fixed to the shade member 51 and to the bracket 54, respectively. The spring 57 energizes the shade member 51 to the bracket 54 in a direction toward a first position P1.

Solenoid

The solenoid 52 generates power to rotate the shade member 51. As shown in FIG. 3, the solenoid 52 includes solenoid coil (drive source) 52*a*, case 52*b*, and plunger 52*c*. The solenoid coil 52*a* is connected to a power supply unit (not shown) via a connector C and functions as a drive source.

The solenoid coil 52*a* is housed inside the case 52*b*. The case 52*b* is formed in such a way that a metal plate with uniform thickness is cut, drilled, bend processed and the like, for example. The case 52*b* is bent so as to be in a rectangular shape when viewed from above. There are formed at a top of the case 52*b* three protrusions 52*f*, 52*g*, and 52*h* which upwardly protrude. The protrusions 52*f*, 52*g* and 52*h* are provided on three different sides at the top of the case 52*b*, respectively. In this embodiment, the protrusion 52*f* is located at a side being backward in the front-rear direction, the protrusion 52*g* is located at a side being forward in the front-rear direction, and the protrusion 52*h* is located at a side being left in the left-right direction. The protrusions 52*f* through 52*h* are respectively inserted into mating holes 61*a* through 61*c* of the bracket 54, which are described later. Since the case 52*b* is formed using the metal plate with uniform thickness, dimensions in a direction of thickness of the three protrusions 52*f* through 52*h* are identical or substantially identical. Namely, dimensions in the front-rear direction of the protrusions 52*f*, 52*g* and dimension in the left-right direction of the protrusion 52*h* are identical or substantially identical.

The plunger 52*c* is inserted into the solenoid coil 52*a* through an aperture 52*d* formed in the case 52*b*. The plunger 52*c* is linearly movable according to power generated by the solenoid coil 52*a*. The plunger 52*c* has a groove 52*e* which is provided over the entire circumference of the same.

Transmission Member

The transmission member 53 transmits power generated by the solenoid 52 to the shade member 51. The transmission member 53 is made of a resin material, for example. As shown in FIG. 3, the transmission member 53 has shaft part 53*a*, action part 53*b*, and engagement part 53*c*. The transmission member 53 has substantially L-shape so that the action part 53*b* and the engagement part 53*c*, which extend outwardly from the shaft part 53*a*, make an angle of approximately 100°.

The shaft part 53*a* is formed to be cylindrical and is provided with a housing part 53*d* to house a support shaft 58 inside. The support shaft 58 is a shaft-like member separate from the transmission member 53. The support shaft 58 has base 58*a* and inserting part 58*b*. The support shaft 58 is housed in the housing part 53*d* with the inserting part 58*b* being rotatable.

A pressing part 53*e* is formed at a tip of the action part 53*b*. The pressing part 53*e* is located under a pressed part 51*e* so that when the movable shade mechanism 50 is driven, the pressing part can press the pressed part 51*e* which is formed in the shade member 51 (see FIGS. 4 and 5). The engagement part 53*c* is formed in a feather-like shape so that it expands as getting away from the shaft part 53*a*. As shown in FIGS. 4 and 5, the engagement part 53*c* is engaged with the groove 52*e* formed in the plunger 52*c* of the solenoid 52. This makes it possible to connect the transmission member 53 to the solenoid 52.

Bracket

The bracket 54 is a plate support member to support the shade member 51 and the solenoid 52. The bracket 54 is formed in such a way that a metal plate is cut, drilled, bend processed and the like, for example. As shown in FIG. 3, the bracket 54 has base 61, shade support 62, reinforcement part 63, and attachment part 64.

The base 61 is disposed horizontally in a vehicle-mounted state. The base 61 supports the solenoid 52. The base 61 has mating holes 61*a*, 61*b*, and 61*c* for supporting the solenoid 52. The mating holes 61*a*, 61*b* have an elongated shape in the left-right direction and are aligned with each other in the front-rear direction. The mating hole 61*c* has an elongated shape in the front-rear direction and is located at one side (e.g., left side) in the left-right direction with respect to positions where the mating holes 61*a*, 61*b* are located. The protrusions 52*f* through 52*h* provided in the case 52*b* of the solenoid 52 are inserted into the mating holes 61*a* through 61*c*, respectively. Regarding two protrusions 52*f* and 52*g* which are to be inserted into the mating holes 61*a* and 61*b* among three protrusions 52*f* through 52*h*, after they are respectively inserted into the mating holes 61*a* and 61*b*, their upper ends are caulked and fixed. This allows the case 52*b* to be engaged with the base 61.

In this configuration, positioning in the front-rear direction is performed in the thickness direction of the protrusions 52*f*, 52*g*. Furthermore, positioning in the left-right direction is performed in the thickness direction of the protrusion 52*h*. Namely, by inserting protrusions 52*f* through 52*h* into the mating holes 61*a* through 61*c*, respectively, it is possible to perform positioning of the case 52*b* in a plate-thickness direction. Therefore, by forming a metal plate so as to have uniform thickness, which is the material for the case 52*b*, it is possible to perform positioning between the base 61 and the solenoid 52 precisely. In addition, since the protrusions 52*f* through 52*h* and the mating holes 61*a* through 61*c* can secure a large margin associating with dimensional accuracy in the longitudinal direction, this makes it possible to cut the case 52*b* and drill the bracket 54 easily.

The base 61 has an opening 61*d* through which the transmission member 53 is disposed. The opening 61*d* is located according to a position where the transmission member 53 is disposed. In this embodiment, the opening 61*d* is provided in the base 61 at a position which is displaced from a center to one side (e.g., to the left side) in the left-right direction, for example. The transmission member 53 is located so that it passes through the opening 61*d* in the up-down direction.

The shade support 62 is provided by being bent from a rear end 61*r* of the base 61 upwardly. The base 61 and the shade support 62 are orthogonal or substantially orthogonal to each other (see FIG. 6). The shade support 62 has base 62*a* and rotary shaft holding portion 62*b*. The rotary shaft holding portions 62*b* are located in the base 62*a* at positions which are shifted away from the shade body 51*a* to both sides in the left-right direction, for example. The rotary shaft holding portion 62*b* is formed substantially in a L-shape by protruding it to the front side from the base 62*a* and then to bend upwardly. The rotary shaft holding portion 62*b* holds the rotary shaft 56 by sandwiching the rotary shaft 56 between the shade member 51 and the base 62*a*. This allows the shade member 51 to be supported rotatably around the rotary shaft 56 by the bracket 54. As shown in FIG. 5, a stopper 51*d* capable of abutting on the bracket 54 is formed in the shade member 51. The stopper 51*d* makes it possible to cause the shade member 51 to rotate until it exceeds the first position P1. In addition, another stopper (not shown), which restricts that the shade member 51 rotates until it exceeds a second position P2, is provided in the bracket 54.

The reinforcement part 63 is provided by being bent from a front end 61*f* of the base 61 downwardly (see FIG. 6). The base 61 and the reinforcement part 63 are orthogonal or substantially orthogonal to each other. The reinforcement part 63 has openings 63*a* and notch part 63*b*. The openings 63*a* are arranged side by side in the left-right direction, for example. The openings 63*a* serve as an indicator to identify the bracket 54 by differentiating positions in the left-right direction and the number of the same, for example. The notch part 63*b* is provided so as to be opened at a position which corresponds to the connector C when viewed from the front side. The openings 63*a* and the notch part 63*b* may not be provided.

In this way, by bending the rear end 61*r* and the front end 61*f* of the base 61 upwardly and downwardly, respectively, the base 61 of the bracket 54 has a greater sectional secondary moment than that being of a plate type. Namely, the bracket 54 is suppressed from being deformed due to vibration, shock, or the like because the base 61 has greater rigidity than that being of the plate type. This allows to suppress the bracket 54 from being deformed, while reducing a gap between the bracket 54 and peripheral components, so that it is possible to miniaturize the movable shade mechanism 50 and the vehicular headlight 100. Furthermore, by bending the rear end 61*r* and the front end 61*f*, the base 61 the bracket 54 has greater rigidity, so that the thickness of a metal plate used as its material can be reduced.

Thus this make it possible to reduce component costs and reduce weight of the bracket 54 of the movable shade mechanism 50.

The attachment parts 64 is provided so as to extend from the base 61 outwardly in the left-right direction. The attachment parts 64 are fixed to the attachment member 40 with a fixing member or the like (not shown). Since the attachment member 40 is fixed to the attachment parts 64 extending from the base 61 which has greater rigidity, it is possible to attach the bracket 54 to the attachment member 40 in a stable state.

Cover Member

The cover member 55 is mounted on the base 61. The cover member 55 is located at a position covering the opening 61*c*1. The cover member 55 prevents external light such as sunlight from being incident on the opening 61*d* by covering the opening 61*c*1. Therefore, since this suppresses external light from irradiating, for example, the transmission member 53 located inside the opening 61*d*, it is possible to suppress a thermal deformation, etc. of the transmission member 53.

Operation

Next, operation of the movable shade mechanism 50 according to this embodiment is described. As mentioned above, when the solenoid 52 is not activated, the spring 57 energizes the shade member 51 to the bracket 54 in a direction toward the first position P1. As a result, as shown in FIG. 2, the shade member 51 is restricted to move with respect to the bracket 54 by the stopper 51*d* and positioned in the first position P1. At this time, the shade member 51 shields a part of light from the light source 10 reflected by the reflector 20. This allows for a low beam light distribution pattern as the light distribution pattern of light emitted from the lens 30.

On the other hand, by electrifying the solenoid 52 and generating magnetic force in the solenoid coil 52*a*, the plunger 52*c* linearly moves to the solenoid coil 52*a* side. Accordingly, the transmission member 53 which is engaged with the groove 52*e* of the plunger 52*c* rotates around the support shaft 58. As a result, the pressing part 53*e* presses up the pressed part 51*e* of the shade member 51 via the engagement part 53*c* of the transmission member 53. Thereby, the shade member 51 rotates against biasing force of the spring 57 around the rotary shaft 56 in a direction toward the second position P2. Then the shade member 51 is restricted to move by the stopper (not shown) provided on the bracket 54 and positioned in the second position P2. At this circumstance, light from the light source 10 reflected by the reflector 20 is emitted from the lens 30 without being shielded by the shade member 51, and thereby forming a high-beam light distribution pattern. Then the solenoid coil 52 stops working when the solenoid 52 is de-electrified. As a result, biasing force of the spring 57 allows the shade member 51 to be positioned in the first position P1, so that the plunger 52*c* is returned to its original position.

As mentioned above, the movable shade mechanism 50 for a vehicular headlight 100 according to this embodiment includes: a shade member 51 rotating around a rotary shaft 56 and adjusting a shielding amount of light from a light source 10; a solenoid 52 to generate power to drive the shade member 51; a transmission member 53 to transmit power of the solenoid 52 to the shade member 51; and a plate bracket 54 to hold the rotary shaft 56 and the solenoid 52, wherein the bracket 54 includes: a base 61 that is disposed along a horizontal plane in a vehicle-mounted state and supports the solenoid 52; and a shade support 62 that is bent upwardly from a rear end 61*r* of the base 61 in the vehicle-mounted state and supports the rotary shaft 56.

According to this configuration, the rear end 61*r* and the front end 61*f* of the base 61 of the bracket 54 are bent upwardly and downwardly, respectively, so that the base 61 has greater rigidity than that being of a plate type. In this way, since the solenoid 52 is held on the base 61 with enhanced rigidity, deformation due to vibration, shock or the like can be suppressed. By enhancing rigidity of the bracket 54, the thickness of the metal plate used as its material can be reduced. This makes it possible to reduce component costs and weight of the movable shade mechanism 50.

In the movable shade mechanism 50 of the vehicular headlight 100 according to this embodiment, the bracket 54 has the reinforcement part 63 which is bent downwardly from the front end 61*f* of the base 61. This makes it possible to further enhance rigidity of the base 61.

In the movable shade mechanism 50 of the vehicular headlight 100 according to this embodiment, the base 61 has attachment parts 64 extending outwardly in the left-right direction in a vehicle-mounted state. Since the attachment member 40 is fixed to the attachment parts 64 extending from the base 61 which has greater rigidity, it is possible to attach the bracket 54 to the attachment member 40 in a stable state.

In the movable shade mechanism 50 of the vehicular headlight 100 according to this embodiment, the base 61 has the opening 61*d* which penetrates through the base in the up-down direction in a vehicle-mounted state, and the transmission member 53 passes through the opening 61*d* in the up-down direction to be disposed. Since rigidity of the base 61 is enhanced, it is possible to provide the opening 61*d* in the base 61 without increasing a plate thickness of the bracket 54.

The movable shade mechanism 50 of the vehicular headlight 100 according to this embodiment further includes the cover member 55 which is mounted on the base 61 and covers the opening 61*d*. Since the cover member 55 covers the opening 61*d*, it can prevent external light such as sunlight from being incident on the opening 61*d*. Thereby, since this suppresses external light from irradiating, for example, the transmission member 53 located inside the opening 61*d*, it is possible to suppress a thermal deformation, etc. of the transmission member 53.

In the movable shade mechanism 50 for a vehicular headlight 100 according to this embodiment, the case 52*b* has a shape that a plate member is bent in an up-down direction and a front-rear direction in the vehicle-mounted state, and has a plurality of protrusions 52*f* through 52*h* to be mated with the base 61 on a top of the case 52*b* in an up-down direction, at least one or more of the plurality of protrusions 52*f* through 52*h* are provided at a position where the up-down direction is a plate thickness direction as well as a position where the front-rear direction is a plate thickness direction, and the base 61 has mating holes 61*a* through 61*c* which the plurality of protrusions 52*f* through 52*h* are inserted into. This configuration allows to perform the positioning in the thickness direction of the protrusions 52*f* through 52*h*, so that, for example, by forming a metal plate so as to have uniform thickness, which is the material for the case 52*b*, dimensional variation can be suppressed. This allows to perform reliable positioning in the front-rear and left-right directions.

The vehicular headlight 100 according to this embodiment includes the movable shade mechanism 50 which controls light distribution of light from the light source 10. This allows to suppress the movable shade mechanism 50 from having influences such as deformation due to vibration, shock, etc., while reducing a gap between the movable shade mechanism 50 and peripheral components, so that it is possible to miniaturize the vehicular headlight 100. In addition, since the bracket 54 can be made lighter, this makes it possible to provide a lightweight vehicular headlight 100.

The technical scope of the present invention is not limited to the above mentioned embodiment, and changes may be made as appropriate without departing from the spirit of the present invention. For example, in the above mentioned embodiment, although an example is given of a configuration in which at least one or more of the plurality of protrusions 52*f* through 52*h* are located at a position in which the front-rear direction is the plate thickness direction as well as at a position in which the left-right direction is the plate thickness direction. The present invention is not limited to this configuration. The plurality of protrusions 52*f* through 52*h* may be provided at any positions where they can mate with the base 61.

Furthermore, in the above mentioned embodiment, although a configuration in which the cover member 55 is provided is described as an example, the present invention is not limited thereto. No cover member 55 may be provided, for example. Also, it may be configured so that a portion of the bracket 54 or other component covers the opening 61*d* in place of the cover member 55.

In the above mentioned embodiment, although an example is given of a configuration in which the opening 61*d* is provided in the base 61 and the transmission member 53 is disposed so as to pass through the opening 61*d*, the present invention is not limited thereto. For example, in the configuration where the transmission member 53 is disposed on the base 61, it may be located at the notch part or the like other than the opening 61*d* if possible.

In the above mentioned embodiment, although an example is given of a configuration in which the attachment parts 64 for fixing to the attachment member 40 extend from the base 61 outwardly is described, the present invention is not limited thereto. The attachment parts 64 may be located in positions other than the base 61. For example, the attachment parts 64 may be configured to extend from the shade support 62 or the reinforcement part 63.

DESCRIPTION OF REFERENCE NUMERALS

AX Optical axis
C Connector
P1 First position
P2 Second position
10 Light source
11 Light emitting surface
20 Reflector
30 Lens
31 Lens holder
40 Attachment member
50 Movable shade mechanism
51 Shade member
51*a* Shade body
51*b* Attachment piece
51*c* Through hole
51*d* Stopper
51*e* Pressed part
52 Solenoid
52*a* Solenoid coil
52*b* Case
52*c* Plunger
52*d* Aperture
52*e* Groove
52*f* through 52*h* Protrusion
53 Transmission member
53*a* Shaft part
53*b* Action part
53*c* Engagement part
53*d* Housing part
53*e* Pressing part
54 Bracket
55 Cover member
56 Rotary shaft
57 Spring
58 Support shaft
58*a*, 62*a* Base
58*b* Inserting part
61 Base
62 Shade support
63 Reinforcement part
61*a* through 61*c* Mating hole
61*d*, 63*a* Opening
61*f* Front end
61*r* Rear end
62*b* Rotary shaft holding portion
63*b* Notch part
64 Attachment part
100 Vehicular headlight

The invention claimed is:

1. A movable shade mechanism for a vehicular headlight comprising:
a shade member rotating around a rotary shaft and adjusting a shielding amount of light from a light source;
a drive unit to generate power to drive the shade member;
a transmission member to transmit power of the drive unit to the shade member; and
a plate bracket to hold the rotary shaft and the drive unit, wherein the bracket includes:
a base that is disposed along a horizontal plane in a vehicle-mounted state and supports the drive unit; and
a shade support that is bent upwardly from a rear end of the base in the vehicle-mounted state and supports the rotary shaft.

2. The movable shade mechanism for a vehicular headlight according to claim 1, wherein
the bracket includes a reinforcement part that is bent downwardly from a front end of the base.

3. The movable shade mechanism for a vehicular headlight according to claim 1, wherein
the base has an attachment part extending outwardly in a left-right direction in the vehicle-mounted state.

4. The movable shade mechanism for a vehicular headlight according to claim 1, wherein
the base has an opening that penetrates through the base in an up-down direction in the vehicle-mounted state, and
the transmission member passes through the opening in the up-down direction to be disposed.

5. The movable shade mechanism for a vehicular headlight according to claim 4 further comprising
a cover member that is mounted on the base and covers the opening.

6. The movable shade mechanism for a vehicular headlight according to claim 1, wherein
the drive unit has a case,
the case has a shape that a plate member is bent in a front-rear direction and a left-right direction in the vehicle-mounted state, and has a plurality of protrusions to be mated with the base on a top of the case in an up-down direction, at least one or more of the plurality of protrusions are provided at a position where the front-rear direction is a plate thickness direction as well as a position where the left-right direction is the plate thickness direction, on the top of the case, and the base has mating holes which the plurality of protrusions are inserted into.

7. A vehicular headlight comprising:

a light source; and the movable shade mechanism for a vehicular headlight according to claim 1, which controls light distribution of light from the light source.

* * * * *